US007581797B2

(12) United States Patent
Kasai

(10) Patent No.: US 7,581,797 B2
(45) Date of Patent: Sep. 1, 2009

(54) ELEMENT BOARD FOR PRINTHEAD, PRINTHEAD, PRINTHEAD CARTRIDGE, AND PRINTING APPARATUS

(75) Inventor: Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 461 days.

(21) Appl. No.: 11/001,863

(22) Filed: Dec. 2, 2004

(65) Prior Publication Data

US 2005/0116975 A1 Jun. 2, 2005

(30) Foreign Application Priority Data

Dec. 2, 2003 (JP) ..... 2003-403738

(51) Int. Cl.
*B41J 29/38* (2006.01)

(52) U.S. Cl. ..... 347/5; 347/12

(58) Field of Classification Search ..... 358/445; 347/5, 12

See application file for complete search history.

(56) References Cited

U.S. PATENT DOCUMENTS

| | | | | |
|---|---|---|---|---|
| 5,933,161 | A * | 8/1999 | Sato et al. | 347/12 |
| 6,139,125 | A | 10/2000 | Otsuka et al. | |
| 6,520,613 | B1 | 2/2003 | Tamura | |
| 6,779,863 | B2 * | 8/2004 | Usuda | 347/14 |
| 2002/0036805 | A1 * | 3/2002 | Kanno et al. | 358/445 |
| 2002/0105556 | A1 * | 8/2002 | Fujii | 347/12 |
| 2002/0105558 | A1 * | 8/2002 | Otsuki | 347/19 |
| 2002/0118241 | A1 * | 8/2002 | Fujii | 347/12 |
| 2004/0201636 | A1 * | 10/2004 | Sato et al. | 347/9 |

FOREIGN PATENT DOCUMENTS

| | | |
|---|---|---|
| JP | 04-353473 A | 12/1992 |
| JP | 5-31906 | 2/1993 |
| JP | 9-327914 | 12/1997 |

OTHER PUBLICATIONS

Japanese Office Action issued on Oct. 31, 2008 concerning basic Japanese Patent Application No. 2003-403738, which a foreign counterpart of the instant application. (Document containing 2 pages in Japanese language is provided).

* cited by examiner

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

In a having a plurality of printing elements, a shift register which serially receives printing data corresponding to the number of printing elements, a latch which latches the printing data input to the shift register, and a driving circuit which selectively drives the printing elements in accordance with the printing data latched by the latch and a signal representing a driving period, the latch state of the latch is controlled by the signal representing the driving period. The signal representing the driving period and a signal for controlling the latch state of the latch are commonly used to decrease the number of input terminals of the .

2 Claims, 12 Drawing Sheets

ELEMENT BOARD FOR PRINTHEAD, PRINTHEAD, PRINTHEAD CARTRIDGE, AND PRINTING APPARATUS

FIELD OF THE INVENTION

The present invention relates to an element board for a , a and control method and, more particularly, to a which has a plurality of printing elements and prints by driving the printing elements in accordance with serially input printing data, and a control method.

The present invention can be applied to a general printing apparatus which prints by using such a , and also to an apparatus (e.g., a copying machine, facsimile apparatus, or wordprocessor) and an industrial printing apparatus compositively combined with various processing apparatuses.

BACKGROUND OF THE INVENTION

A printing apparatus which prints information such as a desired character or image on a sheet-like printing medium such as a paper sheet or film is widely used as an information output apparatus in a wordprocessor, personal computer, facsimile apparatus, and the like.

Various methods are known as printing methods for the printing apparatus. Especially an inkjet method has recently received a great deal of attention because this method can realize noncontact printing on a printing medium such as a paper sheet, easily prints in color, and is quiet. Because of low cost and easy downsizing, a popular inkjet arrangement is a serial printing system in which a for discharging ink in accordance with desired printing information prints while reciprocally scanning in a direction perpendicular to the convey direction of a printing medium such as a paper sheet.

FIG. 11 is a block diagram showing the representative circuit configuration of a conventional inkjet .

In FIG. 11, reference numeral 101 denotes an electrothermal transducer (heater) for generating thermal energy; 102, a power transistor for supplying a desired current to the heater; 103, a shift register which temporarily stores printing data DATA for determining whether to discharge ink from the nozzle of the in accordance with image information to be printed; 104, a transfer clock input terminal which is attached to the shift register and inputs a transfer clock signal CLK; 105, a printing data input terminal for serially inputting the printing data DATA to the shift register; 106, a latch circuit for latching printing data stored in the shift register; 107, a latch signal input terminal for inputting a latch signal LT for controlling the latch timing of the latch circuit 106; 108, a power line for applying a predetermined voltage (VH) to the heater and supplying a current; and 109, a GND line serving as the reference of power or an applied voltage.

FIG. 12 is a timing chart showing various signals for driving the shown in FIG. 11. Reference numeral 201 denotes a transfer clock CLK; 202, printing data DATA; 203, a latch signal (LT); and 204, a heat enable signal HE.

The transfer clock (CLK) pulse 201 is input to the transfer clock input terminal 104. The printing data (DATA) 202 representing ON/OFF of each heater is serially input from the data input terminal 105 so that printing data is transferred to the shift register 103 in synchronism with the two edges of the transfer clock 201. After data is transferred to the shift register 103, the latch 106 latches printing data corresponding to each heater at a timing at which the latch signal (LT) 203 is input to the latch input terminal 107.

At an appropriate timing, the heat enable signal (HE) 204 is supplied. A current flows through the power transistor 102 and heater 101 in accordance with a time during which the heat enable signal is ON (in this example, low level), and ink is discharged in accordance with printing data. If necessary, a time during which the heater is driven may be changed depending on the temperature and the number of simultaneously driven heaters (number of simultaneous ON bits).

In FIG. 12, a pre-pulse 205 is supplied immediately before the heater is driven by the heat enable signal 204. This is based on a technique disclosed in U.S. Pat. No. 6,139,125 (corresponding to Japanese Patent Laid-Open No. 5-31906). This technique intends to keep a at a high temperature and stabilize the ink discharge amount by supplying the pre-pulse 205. The pre-pulse application time is short enough not to discharge ink.

U.S. Pat. No. 6,520,613 (corresponding to Japanese Patent Laid-Open No. 9-327914) discloses an arrangement which decodes signals input from a plurality of signal lines to generate a block selection signal in order to decrease the number of input terminals and improve the reliability.

Recently, inkjet printers are achieving multicolor printing, higher speeds, and higher image qualities, and the printing data amount tends to increase. The number of signals necessary to drive the and the number of input terminals also tend to increase. An increase in the number of input terminals leads to a decrease in connection reliability and an increase in chip area, raising the chip cost.

Since an increase in cost raises the cost of the whole apparatus and the running cost, the number of input terminals is desirably decreased.

SUMMARY OF THE INVENTION

It is an object of the present invention to provide an element board for a in which the number of input terminals is decreased.

It is another object of the present invention to provide a in which the number of input terminals is decreased.

It is further object of the present invention to provide a control method capable of decreasing the number of input terminals of the .

According to an aspect of the present invention, the above object is attained by an element board for a , which has a plurality of printing elements and drives the printing elements in accordance with serially input printing data, comprising: a shift register which serially receives printing data corresponding to the number of printing elements; a latch which latches the printing data input to the shift register; and a driving circuit which selectively drives the printing elements in accordance with the printing data latched by the latch and a signal representing a driving period, wherein the signal representing the driving period is used as a signal for controlling a latch state of the latch.

In order to achieve the another object, according to another aspect of the present invention, there is provided a which has a plurality of printing elements and prints by driving the printing elements in accordance with serially input printing data, comprising: a shift register which serially receives printing data corresponding to the number of printing elements; a latch which latches the printing data input to the shift register; and a driving circuit which selectively drives the printing elements in accordance with the printing data latched by the latch and a signal representing a driving period, wherein the signal representing the driving period is used as a signal for controlling a latch state of the latch.

According to further aspect of the present invention for achieving the further object, there is provided a method of controlling a having a plurality of printing elements, a shift register which serially receives printing data corresponding to the number of printing elements, a latch which latches the printing data input to the shift register, and a driving circuit which selectively drives the printing elements in accordance with the printing data latched by the latch and a signal representing a driving period, comprising controlling a latch state of the latch by the signal representing the driving period.

More specifically, according to the present invention, the latch state of a latch is controlled by a signal representing a driving period in a having a plurality of printing elements, a shift register which serially receives printing data corresponding to the number of printing elements, a latch which latches the printing data input to the shift register, and a driving circuit which selectively drives the printing elements in accordance with the printing data latched by the latch and a signal representing a driving period.

The signal representing the driving period and a signal for controlling the latch state of the latch are commonly used to decrease the number of input terminals of the .

As the number of input terminals is decreased, the chip area and the cost of the can be reduced.

The signal representing the driving period may include a pulse signal, the driving circuit may drive the printing elements in accordance with a level of the pulse signal, and the latch may latch the printing data in accordance with an edge of the pulse signal.

The element board may further comprise delay means for delaying the signal representing the driving period in order to change a timing of the signal which represents the driving period and is input to the latch and the driving circuit.

The signal representing the driving period may include at least two pulse signals.

In this case, the element board may further comprise a signal conversion circuit which converts the at least two pulse signals into a single pulse signal, the pulse signal converted by the signal conversion circuit being used as the signal for controlling the latch state of the latch. Further, a clock signal which defines a timing of inputting the printing data to the shift register may be used as a reset signal to the signal conversion circuit.

The present invention can also be applied to a printing apparatus which prints by using the above , a cartridge having the and an ink tank for holding ink to be supplied to the , and a control method corresponding to the .

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 1 is a block diagram showing the first embodiment of the circuit configuration of a ;

FIG. 3 is a block diagram showing the second embodiment of the circuit configuration of a ;

FIG. 5 is a block diagram showing the circuit configuration of the ;

FIG. 6 is an outer perspective view showing the schematic structure of an inkjet printing apparatus which prints with the ;

FIG. 8 is an exploded perspective view showing the mechanical structure of the ;

DETAILED DESCRIPTION OF THE PREFERRED EMBODIMENTS

Preferred embodiments of the present invention will now be described in detail in accordance with the accompanying drawings. Please note each of constituting elements described in the following embodiments is only an example and is not intended to limit the scope of the present invention thereto.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Further, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Moreover, "nozzle" should be interpreted as any combination of a discharge opening, a channel communicating thereto and an energy-generating element used for discharging ink, without annotation.

A "substrate" (to be also referred to as an "element board" hereinafter) includes not only a base plate made of a silicon semiconductor but also a base plate bearing elements and wiring lines.

In the following description, "on a substrate" means "the surface of a substrate" or "the inside of a substrate near its surface" in addition to "on a substrate". "Built-in" in the present invention does not represent a simple layout of separate elements on a base, but represents integral formation/manufacture of elements on a substrate by a semiconductor circuit manufacturing process.

A printer will be described first as an example of an inkjet printing apparatus which prints by using an inkjet according to the present invention.

<Description of Inkjet Printing Apparatus>

Figure 6:
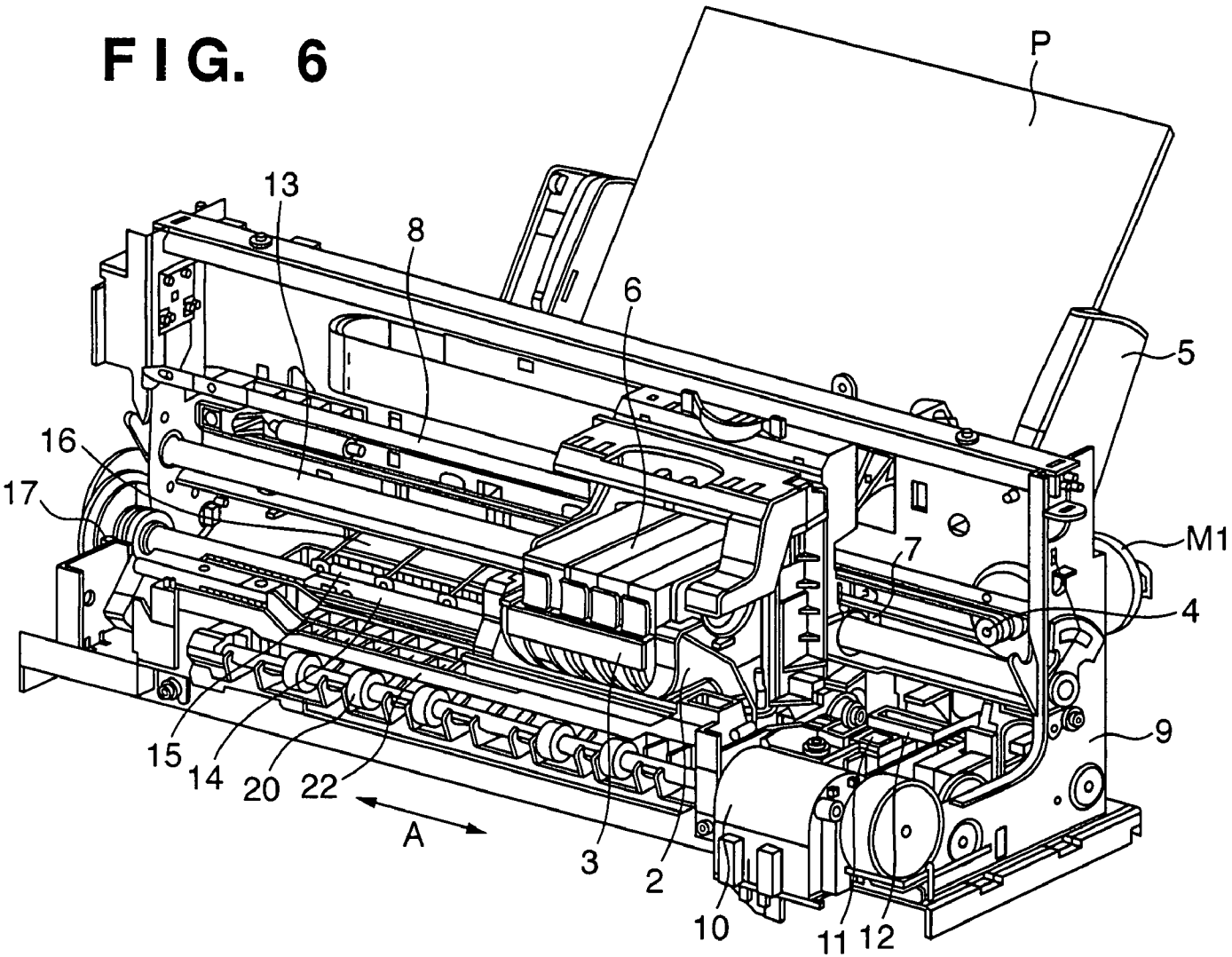

FIG. 6 is an outer perspective view showing the schematic structure of an inkjet printing apparatus which prints with the according to the present invention.

As shown in FIG. 6, in the inkjet printing apparatus (to be referred to as a printing apparatus hereinafter), a transmission mechanism 4 transmits a driving force generated by a carriage motor M1 to a carriage 2 which supports a 3 for discharging ink to print by the inkjet method. The carriage 2 reciprocates in a direction indicated by an arrow A. A printing medium P such as a printing sheet is fed via a sheet feed mechanism 5, and conveyed to a printing position. At the printing position, the 3 discharges ink to the printing medium P to print.

In order to maintain a good state of the 3, the carriage 2 is moved to the position of a recovery device 10, and a discharge recovery process for the 3 is executed intermittently.

The carriage 2 of the printing apparatus supports not only the 3, but also an ink cartridge 6 which stores ink to be supplied to the 3. The ink cartridge 6 is detachably mounted on the carriage 2.

The printing apparatus shown in FIG. 6 can print in color. For this purpose, the carriage 2 supports four ink cartridges which respectively store magenta (M), cyan (C), yellow (Y), and black (K) inks. The four ink cartridges are independently detachable.

The carriage 2 and 3 can achieve and maintain a predetermined electrical connection by properly bringing their contact surfaces into contact with each other. The 3 selectively discharges ink from a plurality of orifices and prints by applying energy in accordance with the printing signal. In particular, the 3 according, to the embodiment adopts an inkjet method of discharging ink by using thermal energy, and comprises an electrothermal transducer in order to generate thermal energy. Electric energy applied to the electrothermal transducer is converted into thermal energy. Ink is discharged from orifices by utilizing a pressure change caused by the growth and contraction of bubbles by film boiling generated by applying the thermal energy to ink. The electrothermal transducer is arranged in correspondence with each orifice, and ink is discharged from a corresponding orifice by applying a pulse voltage to a corresponding electrothermal transducer in accordance with the printing signal.

As shown in FIG. 6, the carriage 2 is coupled to part of a driving belt 7 of the transmission mechanism 4 which transmits the driving force of the carriage motor Ml. The carriage 2 is slidably guided and supported along a guide shaft 13 in the direction indicated by the arrow A. The carriage 2 reciprocates along the guide shaft 13 by normal rotation and reverse rotation of the carriage motor M1. A scale 8 which represents the absolute position of the carriage 2 is arranged along the moving direction (direction indicated by the arrow A) of the carriage 2. In the embodiment, the scale 8 is prepared by printing black bars on a transparent PET film at a necessary pitch. One end of the scale 8 is fixed to a chassis 9, and its other end is supported by a leaf spring (not shown).

The printing apparatus has a platen (not shown) facing the orifice surface of the 3, which has orifices (not shown). Simultaneously when the carriage 2 supporting the 3 reciprocates by the driving force of the carriage motor M1, a printing signal is supplied to the 3 to discharge ink and print on the entire width of the printing medium P conveyed onto the platen.

In FIG. 6, reference numeral 14 denotes a convey roller which is driven by a convey motor M2 in order to convey the printing medium P; 15, a pinch roller which makes the printing medium P abut against the convey roller 14 by a spring (not shown); 16, a pinch roller holder which rotatably supports the pinch roller 15; and 17, a convey roller gear which is fixed to one end of the convey roller 14. The convey roller 14 is driven by rotation of the convey motor M2 that is transmitted to the convey roller gear 17 via an intermediate gear (not shown).

Reference numeral 20 denotes a discharge roller which discharges the printing medium P bearing an image formed by the 3 outside the printing apparatus. The discharge roller 20 is driven by transmitting rotation of the convey motor M2. The discharge roller 20 abuts against a spur roller (not shown) which presses the printing medium P by a spring (not shown). Reference numeral 22 denotes a spur holder which rotatably supports the spur roller.

As shown in FIG. 6, in the printing apparatus, the recovery device 10 which recovers the 3 from a discharge failure is arranged at a desired position (e.g., a position corresponding to the home position) outside the reciprocation range (printing area) for printing operation of the carriage 2 supporting the 3.

The recovery device 10 comprises a capping mechanism 11 which caps the orifice surface of the 3, and a wiping mechanism 12 which cleans the orifice surface of the 3. The recovery device 10 performs a discharge recovery process in which a suction means (suction pump or the like) within the recovery device forcibly discharges ink from orifices in synchronism with capping of the orifice surface by the capping mechanism 11, thereby removing ink with a high viscosity or bubbles in the ink channel of the 3.

In non-printing operation or the like, the orifice surface of the 3 is capped by the capping mechanism 11 to protect the 3 and prevent evaporation and drying of ink. The wiping mechanism 12 is arranged near the capping mechanism 11, and wipes ink droplets attached to the orifice surface of the 3.

The capping mechanism 11 and wiping mechanism 12 can maintain a normal ink discharge state of the 3.

<Control Configuration of Inkjet Printing Apparatus>

Figure 7:
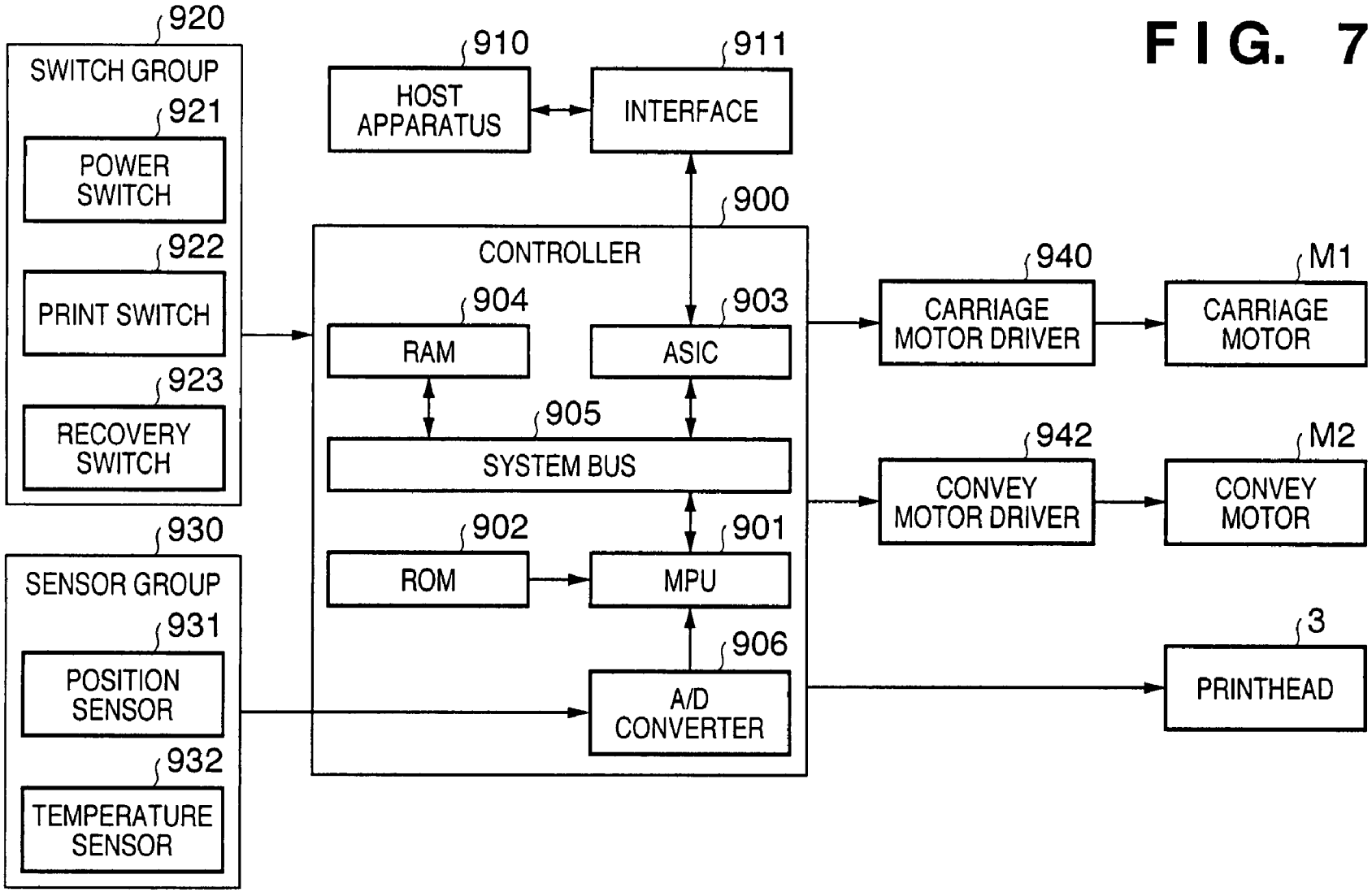
FIG. 7 is a block diagram showing the control configuration of the printing apparatus shown in FIG. 6.

FIG. 7 is a block diagram showing the control configuration of the printing apparatus shown in FIG. 6.

As shown in FIG. 7, a controller 900 comprises an MPU 901, a ROM 902 which stores a program corresponding to a control sequence (to be described later), a predetermined table, and other permanent data, an ASIC (Application Specific IC) 903 which generates control signals for controlling the carriage motor M1, the convey motor M2, and the 3, a RAM 904 having a printing data mapping area, a work area for executing a program, and the like, a system bus 905 which connects the MPU 901, ASIC 903, and RAM 904 to each other and exchanges data, and an A/D converter 906 which A/D-converts analog signals from a sensor group (to be described below) and supplies digital signals to the MPU 901. Further, as described herein after, a signal which serves as both of a heat enable signal (HE) for designating a period for heating the electrothermal transducer of the , and a latch signal is provided from the controller 900 to the .

In FIG. 7, reference numeral 910 denotes a host apparatus such as a computer (or an image reader, digital camera, or the like) serving as a printing data supply source. The host apparatus 910 and printing apparatus transmit/receive printing data, commands, status signals, and the like via an interface (I/F) 911.

Reference numeral 920 denotes a switch group which is formed from switches for receiving instruction inputs from the operator, such as a power switch 921, a print switch 922 for designating the start of print, and a recovery switch 923 for designating the activation of a process (recovery process) of maintaining good ink discharge performance of the 3. Reference numeral 930 denotes a sensor group which detects the state of the apparatus and includes a position sensor 931 such as a photocoupler for detecting a home position h and a temperature sensor 932 arranged at a proper portion of the printing apparatus in order to detect the ambient temperature.

Reference numeral 940 denotes a carriage motor driver which drives the carriage motor M1 for reciprocating the carriage 2 in the direction indicated by the arrow A; and 942, a convey motor driver which drives the convey motor M2 for conveying the printing medium P.

In printing and scanning by the 3, the ASIC 903 transfers driving data (DATA) for a printing element (discharge heater) to the while directly accessing the storage area of the ROM 902.

<Mechanical Structure of >

Figure 8:
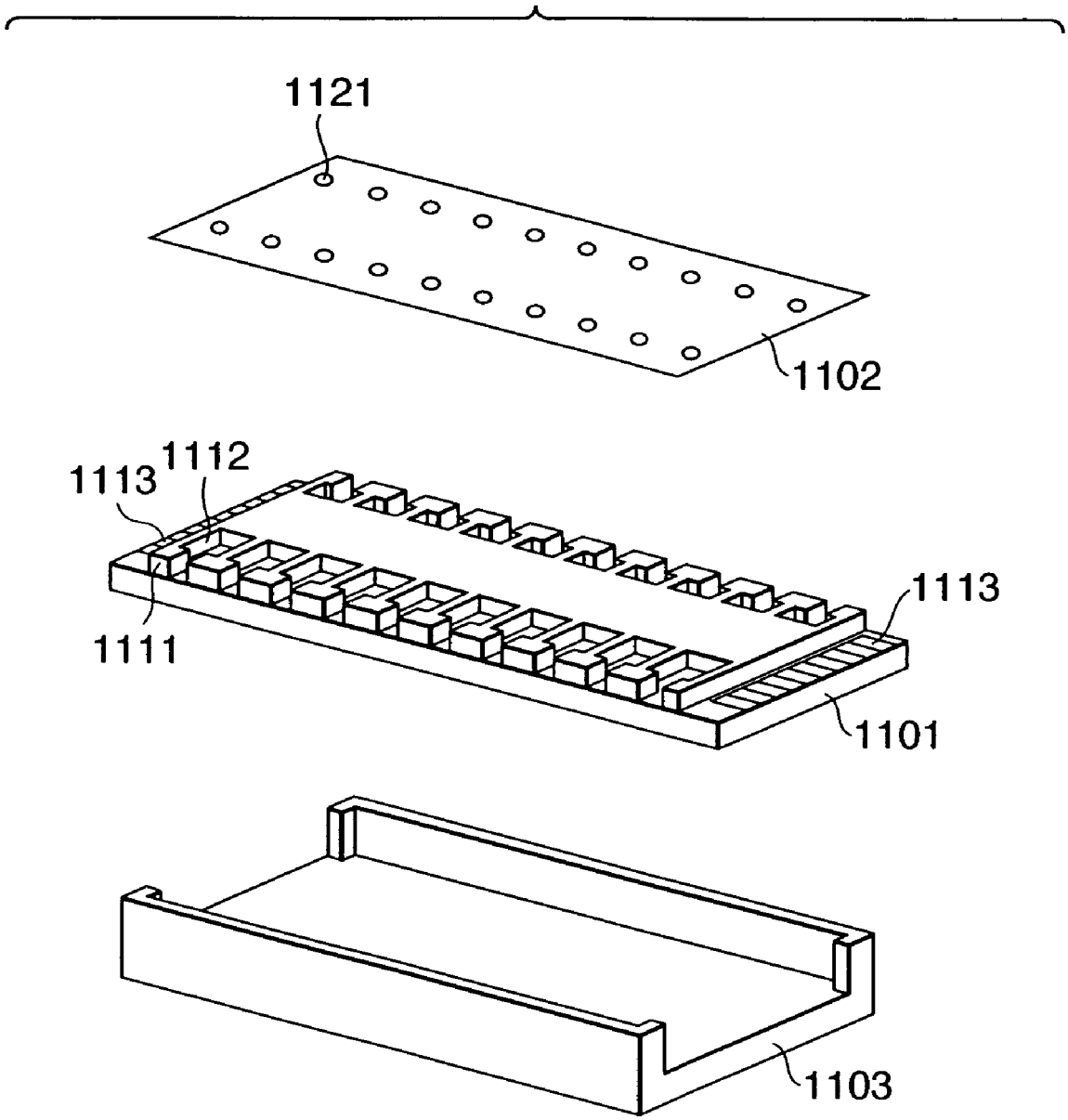

FIG. 8 is an exploded perspective view showing the mechanical structure of the inkjet 3 used in the above-described printing apparatus.

The middle part of FIG. 8 illustrates an element board 1101 prepared by building a circuit configuration (to be described later) into a substrate of silicon or the like. On the element board, heating resistors 1112 are formed as electrothermal transducers which form printing elements. Channels 1111 are formed around the resistors toward the two sides of the substrate. A member which forms the channels can be made of a resin (e.g., dry film), SiN, or the like.

An orifice plate 1102 illustrated above the element board has a plurality of orifices 1121 in correspondence with positions at which they face the heating resistors 1112. The orifice plate 1102 is joined to the member which forms the channels.

A wall member 1103 illustrated below the element board forms a common liquid chamber for supplying ink. Ink is supplied from the common liquid chamber to the channels so as to flow at the periphery of the element board 1101.

Connection terminals 1113 for receiving data and signals from the printing apparatus main body are formed on the two sides of the element board 1101.

<Circuit Configuration of >

Figure 11:
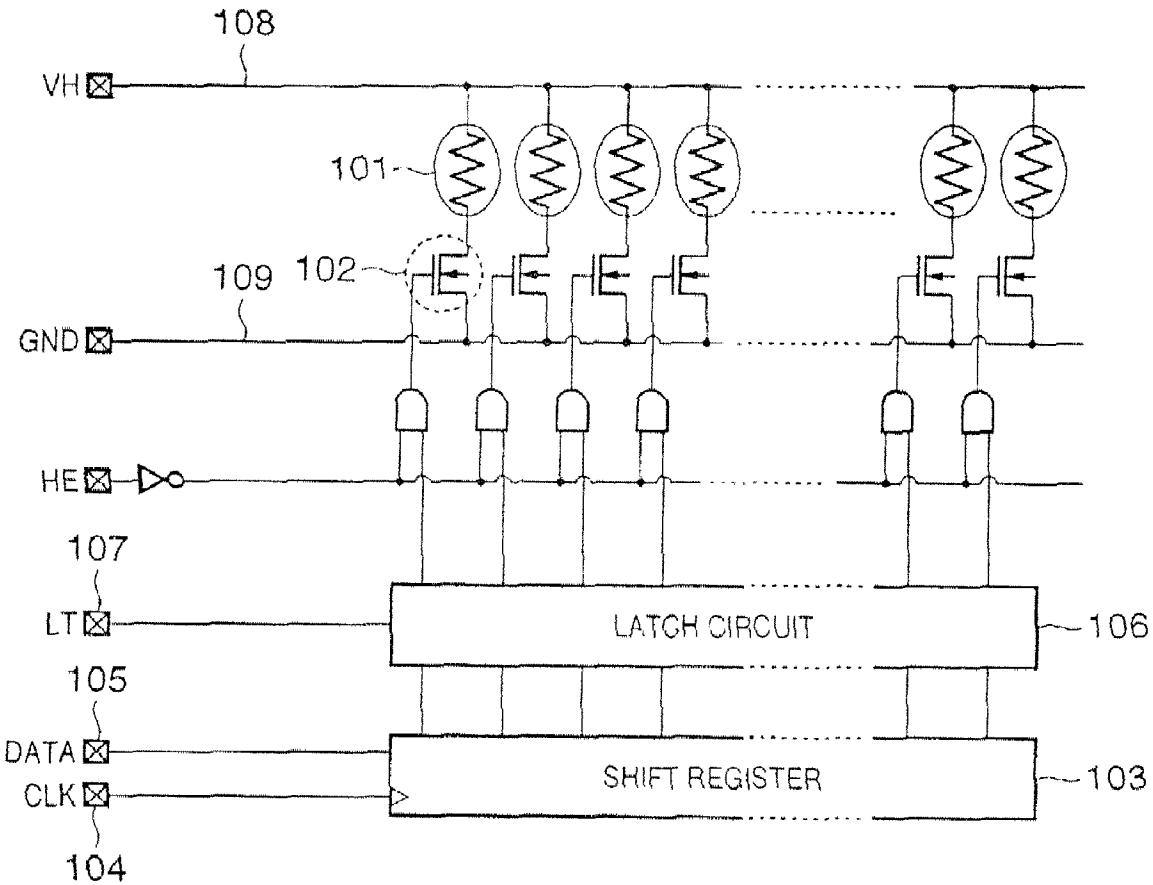
FIG. 11 Prior Art
FIG. 11 is a block diagram showing the circuit configuration of a conventional.
Figure 12:
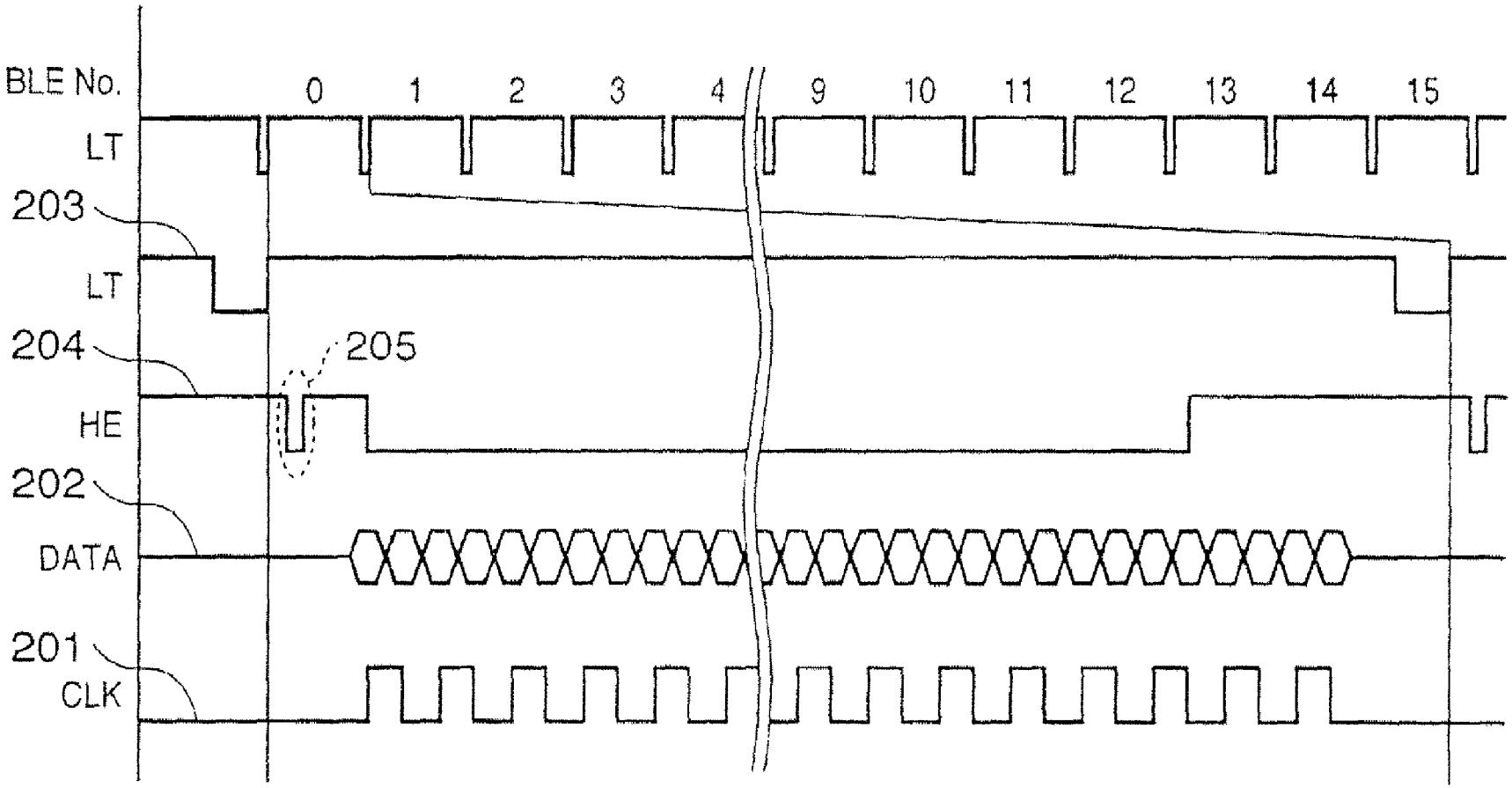
FIG. 12 Prior Art
FIG. 12 is a timing chart showing the states of signals in the circuit of FIG. 11.

Embodiments of the circuit configuration of the inkjet having the above structure will be explained. In the following description, the same reference numerals as those in the prior art described with reference to FIGS. 11 and 12 denote the same parts, and a detailed description thereof will be omitted.

First Embodiment

Figure 1:
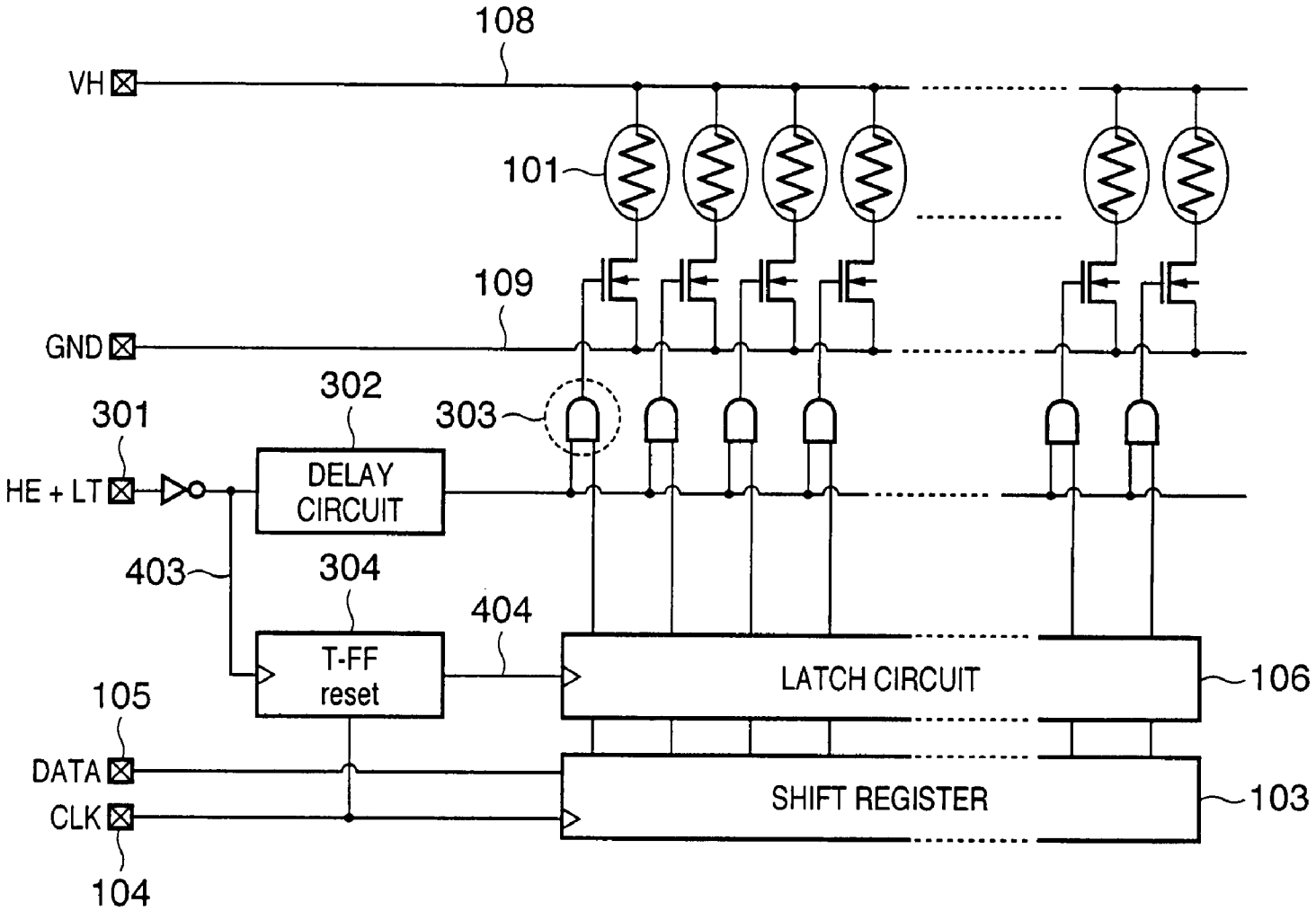
Figure 2A:
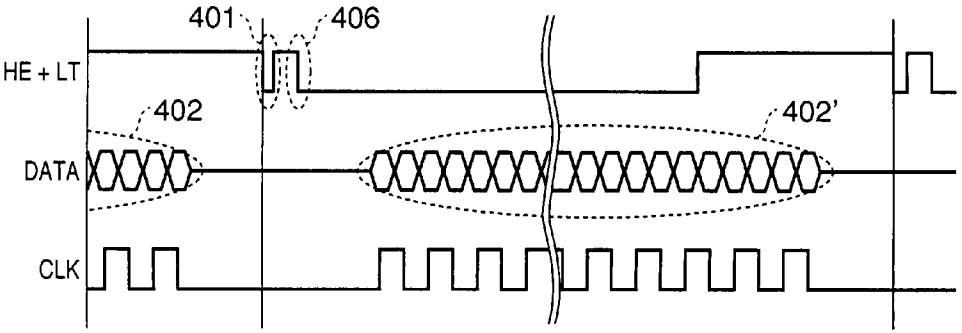
FIGS. 2A and 2B are timing charts showing the states of signals in the circuit of FIG. 1.
Figure 2B:
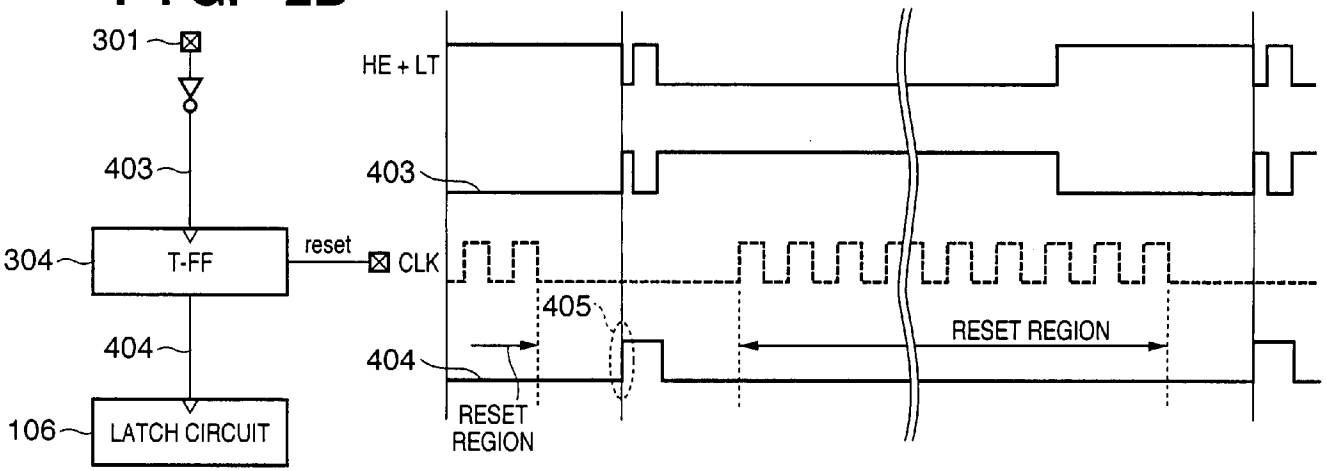

FIG. 1 is a block diagram showing the circuit configuration of the first embodiment of an inkjet according to the present invention. FIGS. 2A and 2B are timing charts showing the states of signals in the circuit of FIG. 1.

Periods and timings of the each signal are as follows. The frequency of the clock signal ranges from 6 to 12 MHz, the ejection frequency (driving frequency) is about 15 kHz, and hence the period of the heat signal is about 4 μsec. The period between falling edge and rising edge of the pre-pulse 401 ranges from 0.2 to 0.6 μsec, the period between falling edge and rising edge of the main pulse 406 ranges from 0.6 to 1.2 μsec, and the rest period between the two pulses ranges from 0.2 to 1.0 μsec. The widths of the pulses change in accordance with temperature rise of the .

In FIG. 1, reference numeral 301 denotes an input terminal which receives an HE+LT signal serving as both a heat enable signal and latch signal; 302, a delay circuit; and 304, a T-flip-flop circuit. The present invention utilizes the trailing edge or leading edge of the HE+LT signal as an edge trigger to the latch circuit. In the embodiment, the trailing edge of the pre-pulse of the heat enable signal as an edge trigger to a latch circuit 106. The delay circuit 302 may be formed by including a plurality of inverters connected in series.

A pre-pulse 401 of the HE+LT signal shown in FIG. 2A also functions as a trigger to the latch circuit 106, and the application timing is very important. The trigger to the latch circuit 106 must be applied at a timing before next DATA 402' is input to a shift register 103 upon completely inputting DATA 402 to the shift register 103. That is, the application timing of the pre-pulse 401 must be set between the immediately preceding DATA transfer 402 and the subsequent DATA transfer 402' while ensuring certain time intervals from the two DATA transfer periods.

When the input signal HE+LT, DATA, and CLK in FIG. 2A are respectively input to the input terminal 301 and input terminals 105 and 104 shown in FIG. 1, the printing data 402 is input to the shift register 103 by DATA in synchronism with the leading and trailing edges of the clock CLK.

A state until the latch circuit 106 is triggered by the HE+LT signal will be explained with reference to FIG. 2B. Upon the lapse of a sufficient time after the end of the printing data transfer 402 by DATA, the signal 403 prepared by inverting the HE+LT signal is input to the T-flip-flop 304. Since the T-flip-flop circuit 304 inverts an output signal at the leading edge of an input signal, the signal 403 is converted into a signal 404, and the signal 404 is input to the latch circuit 106. The latch circuit 106 is triggered at a leading edge 405 of the signal 404, and as a result, triggered at the same timing as the trailing edge of the pre-pulse of the HE+LT signal. By this trigger, the printing data 402 stored in the shift register 103 is so determined to be latched in the latch circuit 106. After that, a heat enable signal having passed through the delay circuit 302 is input to an and circuit 303 with a delay.

The delay time by the delay circuit 302 is set longer than a time until latch of data is determined after the trigger is input to the latch circuit 106. The delay circuit 302 is so arranged as to reliably print in accordance with latched printing data. Assuming that no delay circuit 302 exists, the heat enable signal may drive a heater simultaneously when or before the latch circuit 106 determines latch of printing data, and printing may be done in accordance with undetermined erroneous (unstable) printing data. To prevent this, according to the first embodiment, a heater is driven upon the lapse of a certain time after data to be printed is reliably latched by the latch circuit 106, and printing is reliably done in accordance with correct printing data.

The first embodiment uses a CLK signal as a reset signal to the T-flip-flop circuit 304. Every time the CLK signal changes to high level, reset signals are successively input to the T-flip-flop circuit 304. As shown in FIG. 2B, the reset signal (CLK signal) is input a plurality of number of times immediately before the pre-pulse. This mechanism reliably changes an output from the T-flip-flop circuit 304 to low level immediately before input of the pre-pulse, and prevents malfunction of the circuit. Hence, the latch circuit 106 is always reliably triggered at the timing 405, i.e., the trailing edge timing of the pre-pulse 401 of the HE+LT signal. Since data is reliably latched at this timing, a time until a heater is driven after logic (input data) is latched can be sufficiently ensured to more surely print.

Further, the decrease in the number of signals improves the reliability, and the rise of driving frequency is expected by removing the latch signal. That is, since both of the latch and heat (with delay time) timings are defined at the same time, the margin between the signals can be omitted thereby to shorten the period therefore, when the signal is generated at the outside.

In addition, the circuit of the first embodiment can cope with a single-pulse heat enable signal. When a single pulse is input to the HE+LT terminal 301, an output from the T-flip-flop circuit 304 changes to high level, but falls in response to input of the reset signal (CLK) and keeps low level until the next pulse is input. For this reason, the circuit of the first embodiment can cope with both single- and double-pulse heat enable signals.

The first embodiment adopts the T-flip-flop as a signal conversion means for obtaining a latch trigger from the HE+LT signal, but a circuit other than the flip-flop may be used as the signal conversion means.

Similarly, the first embodiment utilizes a delay circuit as a delay means for delaying a heat enable signal, but a delay may be attained by a circuit other than the delay circuit. For example, a delay by a wiring path may be employed. Otherwise, the delay circuit, which includes a plurality of inverters connected in series may be used.

(Modification)

As described with reference to FIG. 2A, the timing of the pre-pulse 401 of the HE+LT signal and the timing of a trailing edge 406 of the main pulse must be set between the DATA signals 402 and 402'. If the interval between the DATA 402 and the pre-pulse 401 and that between the trailing edge 406 of the main pulse and the start timing of DATA 402' can be ensured for times enough to stabilize the operations of respective portions, a signal conversion circuit such as the T-flip-flop circuit 304 shown in FIG. 1 need not be used.

Figure 5:
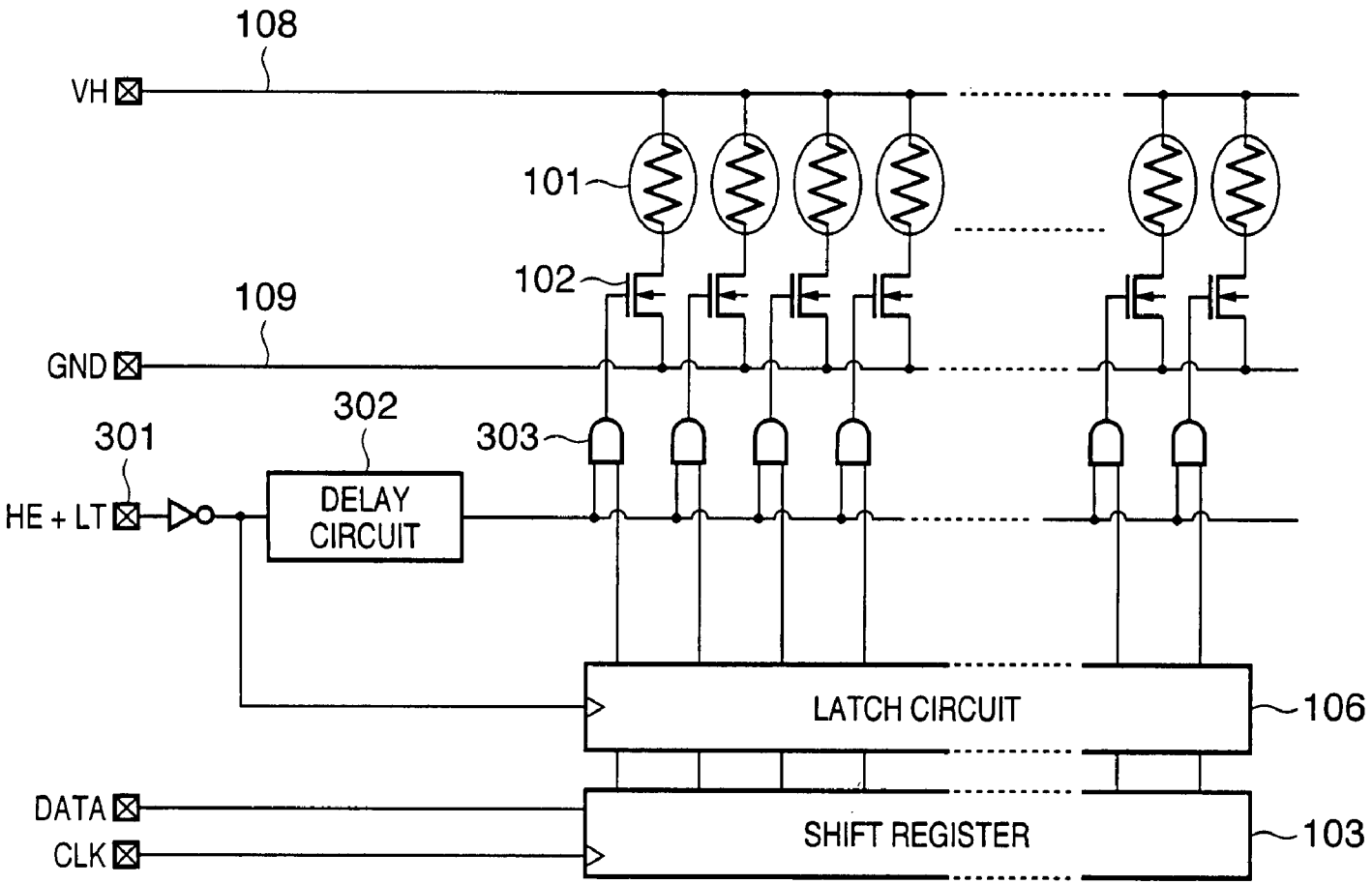

FIG. 5 is a block diagram showing a modification to the circuit of the inkjet which can be adopted when the above condition is satisfied. When signals identical to those shown in FIG. 2A are input to the circuit in FIG. 5, the latch circuit 106 is triggered at the two timings of the trailing edge of the pre-pulse 401 and the trailing edge 406 of the main pulse. However, data which are latched by the latch circuit 106 at the two timings are the same, and no problem occurs in driving.

Figure 3:
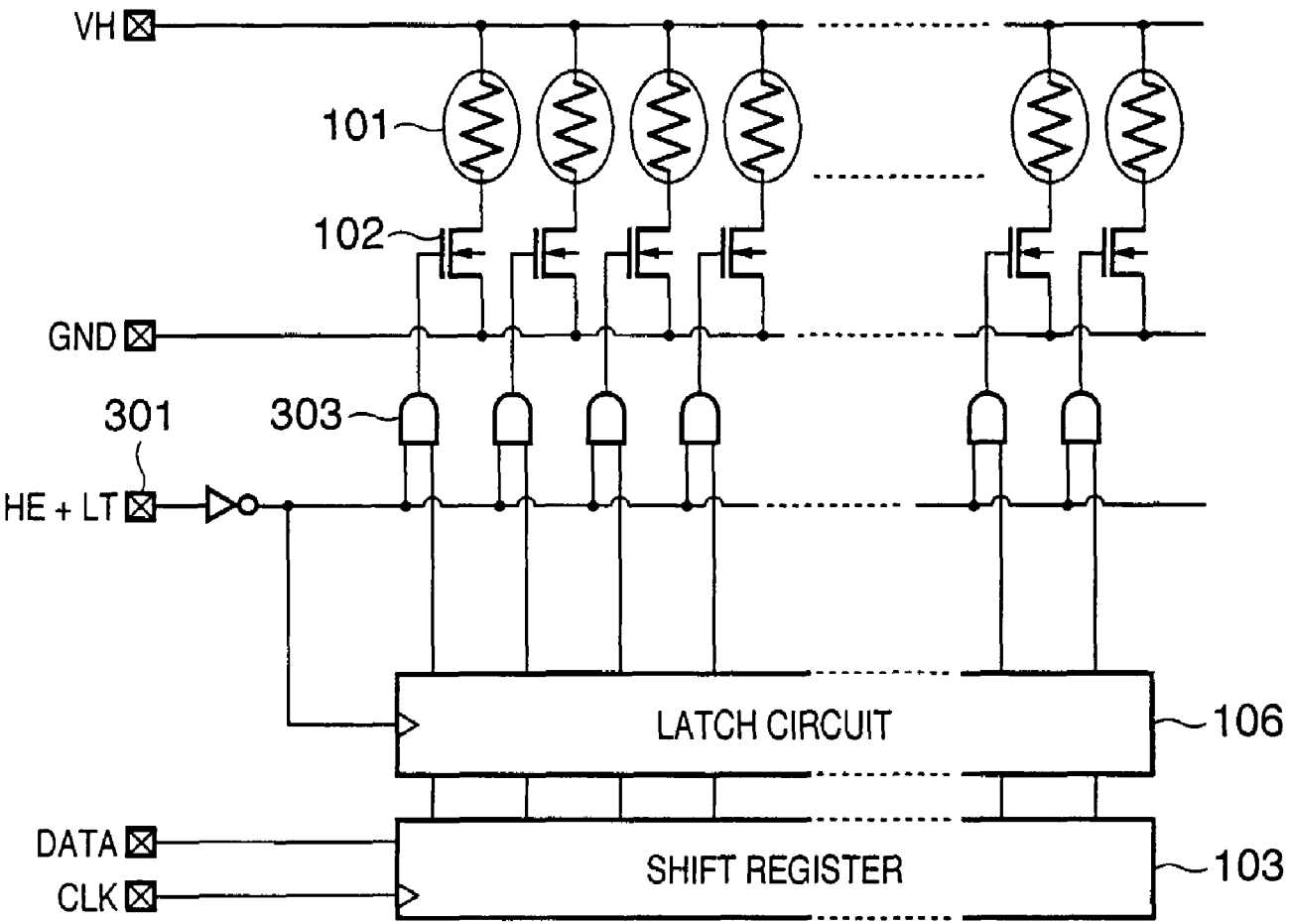

When the input signals shown in FIG. 2A meet the above condition, the circuit of the inkjet may be modified into a circuit as shown in FIG. 3 without using the delay circuit 302 and T-flip-flop circuit 304 in FIG. 1. In the use of the circuit of FIG. 3, the pre-pulse 401 must be used for only triggering the latch circuit 106 without the original pre-heat function for stabilizing discharge.

Second Embodiment

The second embodiment of the circuit configuration of an inkjet according to the present invention will be described. In the following description, a description of the same parts as those in the first embodiment will be omitted, and characteristic features of the second embodiment will be mainly explained.

In the first embodiment, a double-pulse heat enable signal is input as the HE+LT signal, and the leading edge of a pre-pulse signal is used as a trigger to the latch circuit. In the second embodiment, a single-pulse heat enable signal is input as the HE+LT signal, and the leading edge of a pulse signal is used as a trigger to the latch circuit.

Figure 4A:
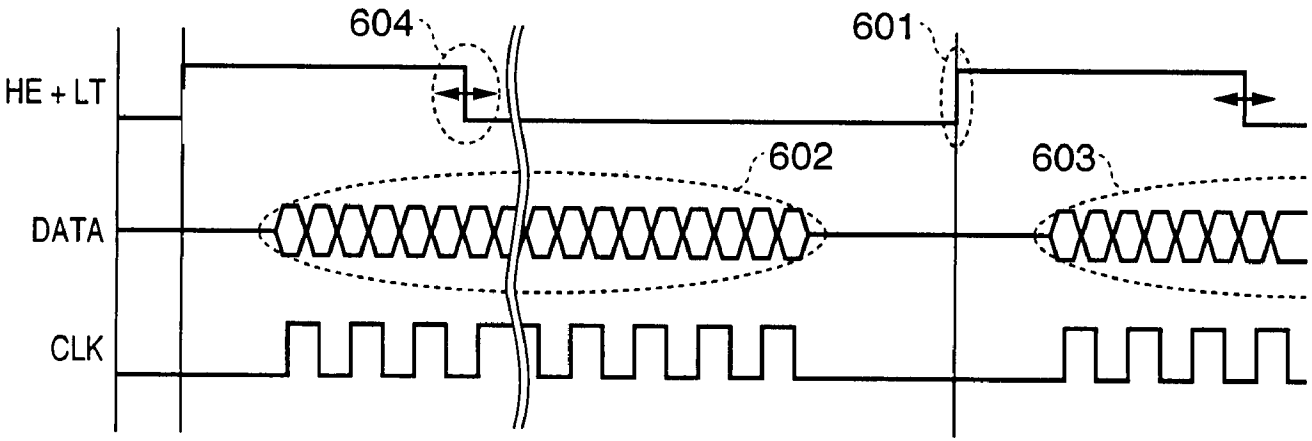
FIGS. 4A and 4B are timing charts showing the states of signals in the circuit of FIG. 3.

FIG. 4A is a timing chart showing the states of signals according to the second embodiment.

In FIG. 4A, the timing of a pulse leading edge 601 of an LT+HE signal is set between DATA signals 602 and 603 while ensuring sufficient time intervals from both the DATA signals 602 and 603.

In the prior art and the first embodiment, the heat pulse width is adjusted by shifting the leading edge position of the heat enable signal. In the second embodiment, however, the leading edge of the HE+LT signal (heat enable signal) is utilized as an edge trigger to the latch, and it is not preferable to adjust the leading edge position. For this reason, in the second embodiment, the pulse width is adjusted by fixing the leading edge position 601 of the heat pulse and adjusting the position (timing) of a trailing edge 604.

By using input signals as shown in FIG. 4A, a delay circuit 302 and signal conversion circuit (T-flip-flop circuit 304) can be omitted from the circuit of the inkjet , unlike the first embodiment. The circuit can be simplified by only eliminating input terminals from a conventional circuit as shown in FIG. 3.

(Modification)

In the above example, the leading edge of a pulse is used as a latch trigger when a single-pulse heat enable signal is adopted as the HE+LT signal. The trailing edge of a pulse can also be used as the latch trigger.

Figure 4B:
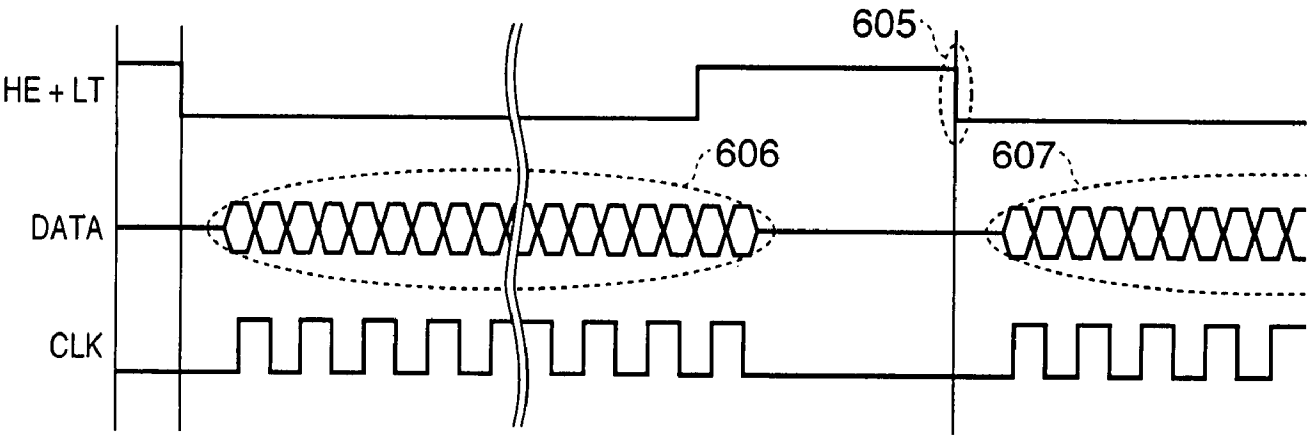

FIG. 4B is a timing chart showing the states of input signals in this case. In FIG. 4B, the timing of the LT+HE signal is set between DATA signals 606 and 607 while ensuring sufficient time intervals from both the DATA signals 606 and 607. In this case, the pulse width is adjusted by shifting the leading edge timing of the heat pulse forth or back, similar to the prior art and the first embodiment.

When input signals as shown in FIG. 4B are used, the circuit of the inkjet can be modified into a circuit as shown in FIG. 5 that includes only the delay circuit 302 by excluding the T-flip-flop circuit 304 from the circuit of FIG. 1.

In the second embodiment and its modification, the delay means is not limited to a delay circuit, and for example, a delay by a wiring path may be utilized.

Note that each of configurations represented by the equivalent circuits of FIGS. 1, 3, and 5 described in the above embodiments is desirably built in the same base. In this case, the number of input terminals of the is decreased, thereby the reliability of the connection between the main body and the is improved. Further, along with the decrease in the number of the input terminals, the chip area (element board) can be reduced, thereby the cost of the can be reduced.

( Cartridge)

The present invention can also be applied to a cartridge having the above-described and an ink tank for holding ink to be supplied to the . The form of the cartridge may be a structure integrated with the ink tank or a structure separable from the ink tank.

Figure 9:
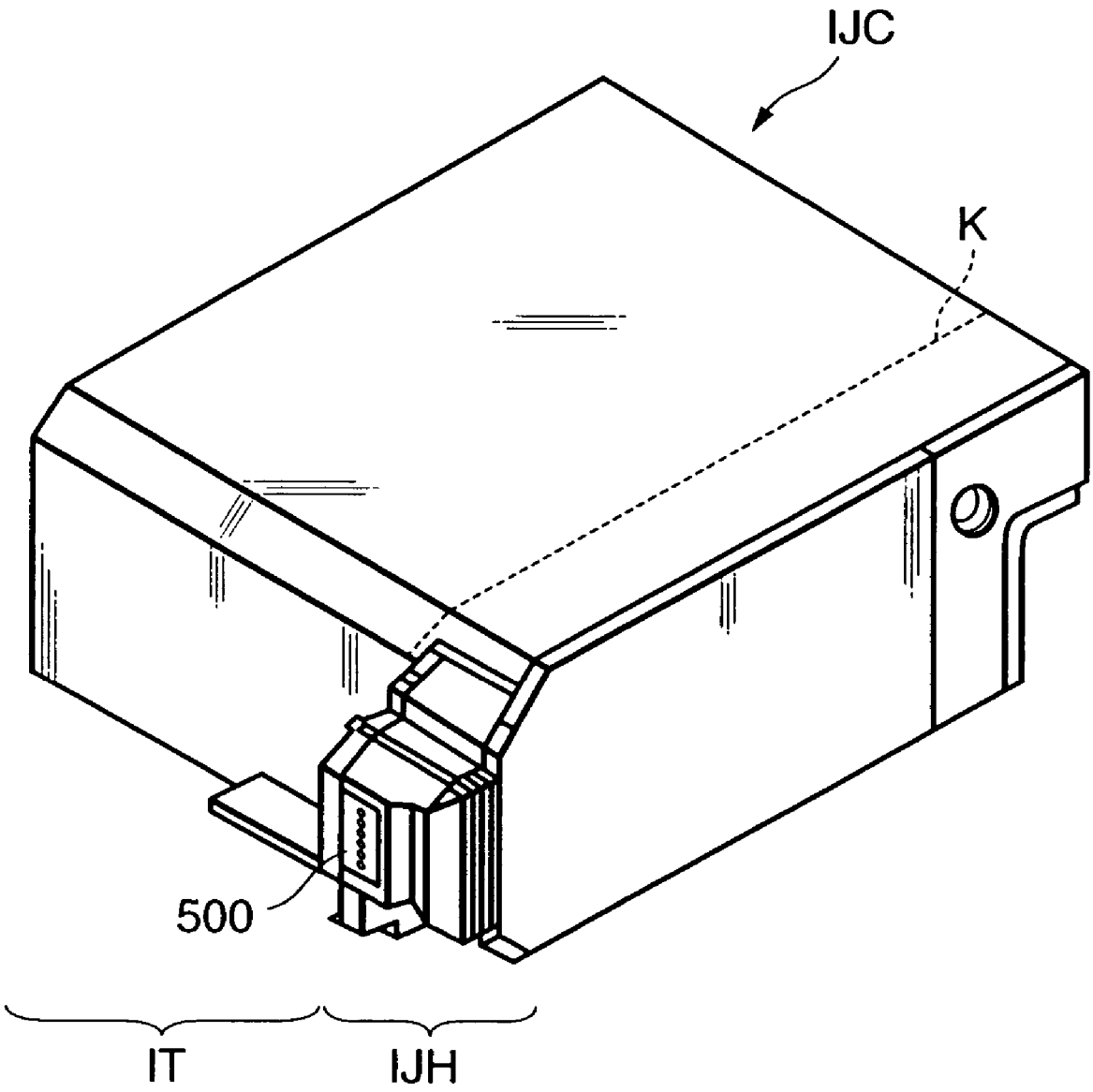
FIG. 9 is a perspective view showing the first structure of a cartridge.

FIG. 9 is an outer perspective view showing the structure of a cartridge IJC obtained by integrating an ink tank and . Inside the cartridge IJC, an ink tank IT and IJH are separated at the position of a boundary K shown in FIG. 9, but cannot be individually replaced. The cartridge IJC has an electrode (not shown) for receiving an electrical signal supplied from a carriage HC when the cartridge IJC is mounted on the carriage HC. This electrical signal drives the IJH to discharge ink, as described above.

In FIG. 9, reference numeral 500 denotes an ink orifice array having a black nozzle array and color nozzle array. The ink tank IT is equipped with a fibrous or porous ink absorber in order to hold ink.

Figure 10:
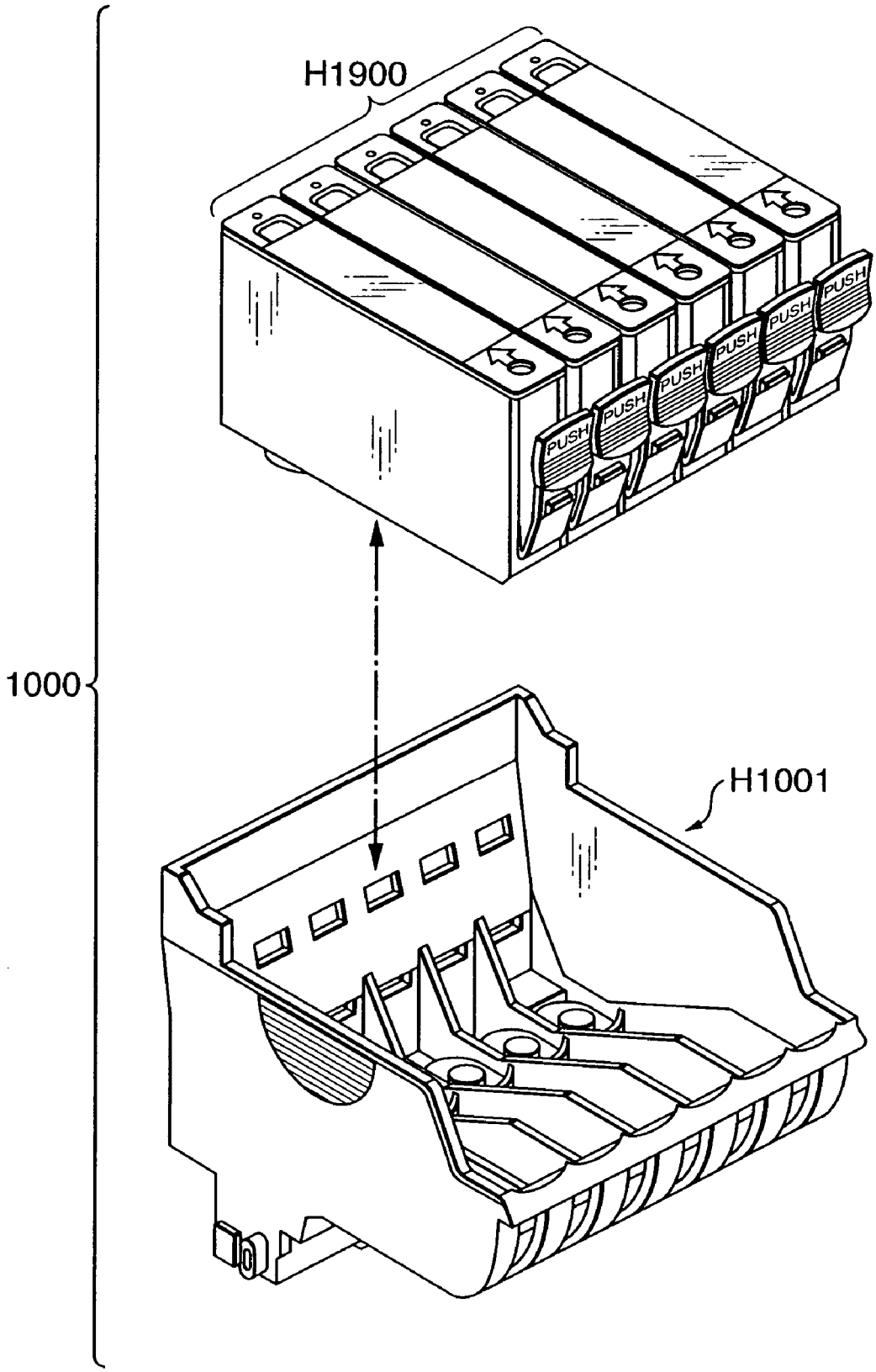
FIG. 10 is a perspective view showing the second structure of the cartridge.

FIG. 10 is an outer perspective view showing the structure of a cartridge in which an ink tank and are separable. A cartridge H1000 comprises an ink tank H1900 which stores ink, and a H1001 which discharges, from a nozzle, ink supplied from the ink tank H1900 in accordance with printing information. The cartridge H1000 adopts a so-called cartridge system in which the cartridge H1000 is detachably mounted on the carriage.

In the cartridge H1000 shown in FIG. 10, independent ink tanks for, black, light cyan, light magenta, cyan, magenta, and yellow are prepared as ink tanks in order to implement photographic high-quality color printing. As shown in FIG. 10, these ink tanks are freely detachable from the H1001.

Other Embodiment

The above embodiments have exemplified, as a according to the present invention, an inkjet which discharges ink by using heat generated by an electrothermal transducer (heater). The present invention can also be applied to a of another type as far as serially input printing data are latched.

A printing apparatus using the according to the present invention may adopt a serial structure in which printing is performed by scanning a carriage supporting the in a direction perpendicular to a printing medium convey direction, or a full-line structure in which a with a length corresponding to the maximum printing width of a printing medium is arranged and printing is performed by moving a printing medium relatively to the .

The number of s of the printing apparatus can be set in correspondence with the type of ink (printing agent) used for printing. The use of a plurality of s implements multitone printing using light and dark inks (printing agents) of a single color and full-color printing using many color inks such as C, M, Y, and K inks.

The present invention can be applied to not only a and a method of transferring a signal to the , but also an apparatus (printer, facsimile apparatus, copying machine, or the like) which prints by using a , and a system including such an apparatus and a host device (computer or the like).

As many apparently widely different embodiments of the present invention can be made without departing from the spirit and scope thereof, it is to be understood that the invention is not limited to the specific embodiments thereof except as defined in the claims.

CLAIM OF PRIORITY

This application claims priority from Japanese Patent Application No. 2003-403738 filed on Dec. 2, 2003, which is hereby incorporated by reference herein.

What is claimed is:

1. An element board for a , which has a plurality of printing elements and drives the printing elements in accordance with serially input printing data, comprising:

a shift register which serially receives printing data corresponding to the number of printing elements from a data input terminal, receives a clock signal from a clock input terminal, and outputs the received printing data in parallel to a latch circuit;

an input terminal which receives an enable signal of at least two pulses, said enable signal serving both as a heat enable signal and a latch signal;

said latch circuit latches the printing data input to said shift register in response to said latch signal;

a driving circuit which selectively drives the printing elements in accordance with the printing data latched by said latch circuit and the heat enable signal representing a driving period of the printing elements, said heat enable signal is delayed with respect to the latch signal; and a signal conversion circuit which converts said enable signal of at least two pulses into a single pulse signal, the pulse signal converted by said signal conversion circuit being used as the signal for controlling a latch state of said latch circuit.

2. An element board for a , which has a plurality of printing elements and drives the printing elements in accordance with serially input printing data, comprising:

a shift register which serially receives printing data corresponding to the number of printing elements from a data input terminal, receives a clock signal from a clock input terminal, and outputs the received printing data in parallel to a latch circuit;

an input terminal which receives an enable signal of at least two pulses, said enable signal serving both as heat enable signal and a latch signal;

said latch circuit latches the printing data input to said shift register in response to said latch signal;

a driving circuit which selectively drives the printing elements in accordance with the printing data latched by said latch circuit and the heat enable signal representing a driving period of the printing elements, wherein said heat enable signal is delayed with respect to the latch signal; and a signal conversion circuit which converts said enable signal of at least two pulses into a single pulse signal, the pulse signal converted by said signal conversion circuit being used as the signal for controlling a latch state of said latch circuit, wherein the clock signal which defines a timing of inputting the printing data to said shift register is used as a reset signal to said signal conversion circuit.

* * * * *